US007426847B2

(12) United States Patent
Congreaves

(10) Patent No.: US 7,426,847 B2
(45) Date of Patent: Sep. 23, 2008

(54) UNIVERSAL VEHICLE ANCHORING SYSTEM AND METHOD OF USE THEREOF

(76) Inventor: Rodney Congreaves, 655 McKinley Ct., Kissimmee, FL (US) 34758

( * ) Notice: Subject to any disclaimer, the term of this patent is extended or adjusted under 35 U.S.C. 154(b) by 28 days.

(21) Appl. No.: 11/347,721

(22) Filed: Feb. 6, 2006

(65) Prior Publication Data

US 2007/0180888 A1 Aug. 9, 2007

(51) Int. Cl.
*B21J 13/08* (2006.01)

(52) U.S. Cl. ..... 72/457; 72/305; 72/705

(58) Field of Classification Search ..... 72/295, 72/305, 457, 705

See application file for complete search history.

(56) References Cited

U.S. PATENT DOCUMENTS 4,337,636 A * 7/1982 Clausen ..... 72/457
4,516,423 A * 5/1985 Reich ..... 72/422
4,606,216 A 8/1986 Riutta
4,745,791 A * 5/1988 Fish ..... 72/305
4,898,019 A 2/1990 Rich
5,031,438 A * 7/1991 Flannery ..... 72/305
6,098,445 A * 8/2000 Meis ..... 72/457
6,185,982 B1 2/2001 Ballard
6,216,524 B1 * 4/2001 Weschler ..... 72/457
6,745,612 B1 6/2004 McIlwraith
6,978,652 B1 * 12/2005 Meis ..... 72/457

* cited by examiner

*Primary Examiner*—Edward Tolan
(74) *Attorney, Agent, or Firm*—Elsie C. Turner

(57) ABSTRACT

An improved apparatus and method of securing a vehicle to a conventional vehicle repair frame rack utilizes conventional and readily available T-brackets or angle irons welded to four corners of the base of the vehicle to be repaired. A pair of square crossbeams extending in parallel from side to side, one of them near the vehicle's forward and the other near the aft end, under the base of the vehicle, are removably attached to the clamping tie-down members of the frame rack by sliding insertion through a first pair of aligned sleeves, each sleeve affixed to a bracket clamped by a tie-down member of the frame rack. Each crossbeam is releasably attached to the base of the vehicle by sliding insertion through a second pair of aligned sleeves bearing clamping assemblies, each clamping assembly of the invention being clamped to a T bracket welded onto the rocker panel, or angle iron, as the case may be, welded onto the bottom of the base of full-size-frame vehicles. Locking bolts penetrate each sleeve and are biased against the square crossbeams to secure against movement during pulling operations.

4 Claims, 4 Drawing Sheets

UNIVERSAL VEHICLE ANCHORING SYSTEM AND METHOD OF USE THEREOF

FIELD OF THE INVENTION

The present invention relates to vehicle repair systems, and more particularly to an apparatus and method for securing a vehicle in a stationary position during body straightening procedures.

BACKGROUND OF THE INVENTION

Repairing collision damage to vehicle bodies frequently involves pulling on damaged areas with considerable force, thus requiring the frame to be secured against movement while the damaged area is straightened. Traditionally it was the practice to tie down the vehicle frame with chains and hooks, which could result in further damage to the vehicle, depending on the direction and strength of the pulling forces. Modem body straightening techniques have evolved whereby a damaged vehicle is mounted and secured on a vehicle repair rack so that the exact location of various data points on the vehicle can be measured and repaired, and resistance is provided against pulling forces so that integrity of the undamaged parts of the vehicle is maintained. Typically a conventional repair system utilizes a frame rack consisting of a pair of parallel spaced apart tie-down tracks equipped with four clamping tie-down members, at least two on each track, which can be positioned so as to attach to pinch welds, or other parts, at four corners at the base of a vehicle. It is important that the vehicle to be repaired must rest on the attachments, not on its wheels. As for securing the frame, body styles have changed, and so have the pinch welds. Also, some vehicles have no pinch welds, and others have jack mounts along the rocker panels. For a vehicle body repair shop, this has meant investing in an attachment system for each type of vehicle, requiring more storage area as well as higher equipment costs. Further, the known systems are means of securing the frame at four points to parallel tie down tracks which provide external rigidity to the frame in the fore-to-aft direction, but, with two exceptions, no external rigidity laterally. The exceptions, U.S. Pat. No. 6,745,612 to McIlwraith, and U.S. Pat. No. 4,606,216 to Riutta, teach a full-frame rectangular anchoring system with a rectangular support frame resting on small stands. McIlwriath has rotatable clamping assemblies attachable to a vehicle frame, allowing them to be leveled with respect to the support frame. This invention is very complex with many non-standard, custom-made parts and would be very expensive to manufacture and complicated to use. In particular, both inventions fail to take advantage of the stability and strength of the tie-down tracks of a conventional vehicle frame repair rack on a lift, to reduce cost and complexity as well as to supply a sturdier support than the small stands on which the support frame rests. Thus there is a need for an apparatus for securing varying auto body types and sizes to a conventional vehicle frame rack that is simple to use and inexpensive, that adds external lateral rigidity to the longitudinal stability of a vehicle frame rack, so as to counter pulling forces from any direction on a vehicle to be repaired. Additionally, there is a need for a system that is adaptable to various body types with or without pinch welds.

SUMMARY OF THE INVENTION

An improved apparatus and method of securing a vehicle to a conventional vehicle repair frame rack utilizes conventional and readily available T-brackets or angle irons welded to four corners of the base of the vehicle to be repaired. A pair of square crossbeams extending in parallel from side to side, one of them forward and the other aft, under the base of the vehicle, are removably attached to the tie-down members of the frame rack by sliding insertion through a first pair of aligned sleeves, each sleeve affixed to an angle iron clamped by a tie-down member of the frame rack. Each square crossbeam is releasably attached to the base of the vehicle by sliding insertion through a second pair of aligned sleeves bearing clamping assemblies, each clamping assembly of the invention being clamped to a T bracket welded to the rocker panel, or angle iron, as the case may be, welded onto the bottom of the base of full-size-frame vehicles. Locking bolts penetrate each sleeve and are biased against the square crossbeams to secure against movement during pulling operations.

DETAILED DESCRIPTION OF THE PREFERRED EMBODIMENT

Figure 1:
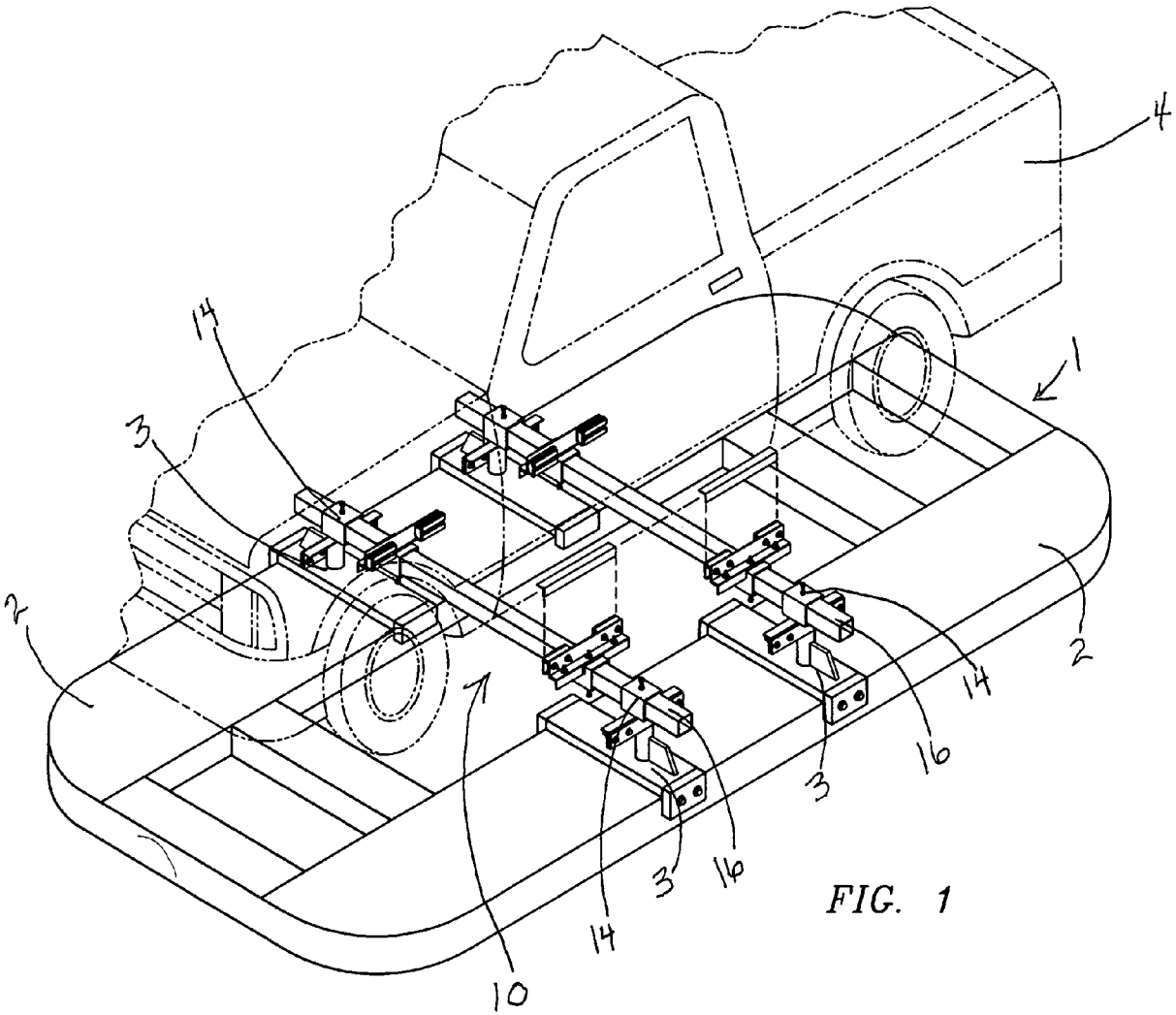
FIG. 1 is a perspective view of my invention with exploded portion of attachment to a vehicle shown in phantom.
Figure 2:
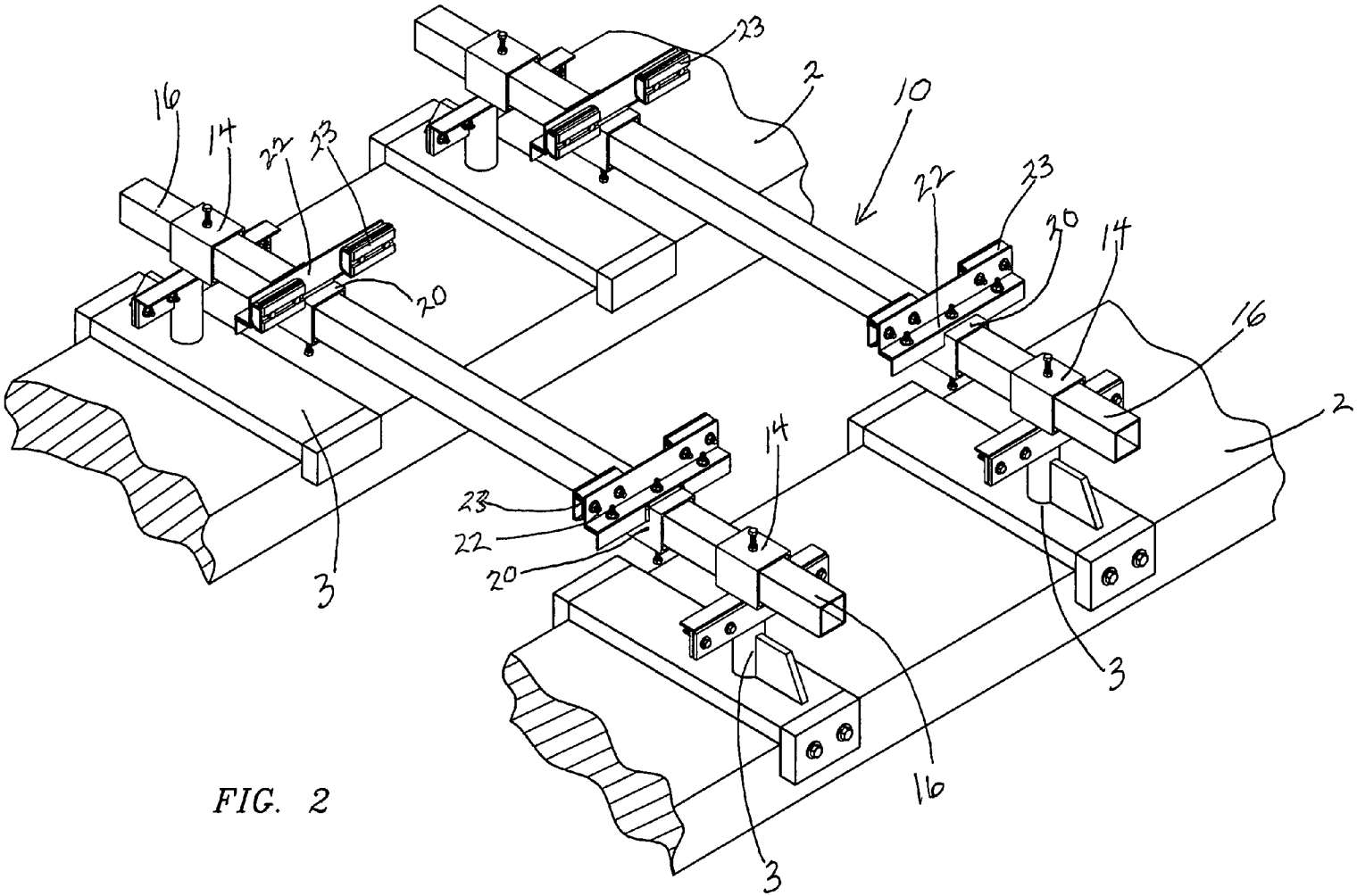
FIG. 2 is an enlarged perspective view thereof.
Figure 3:
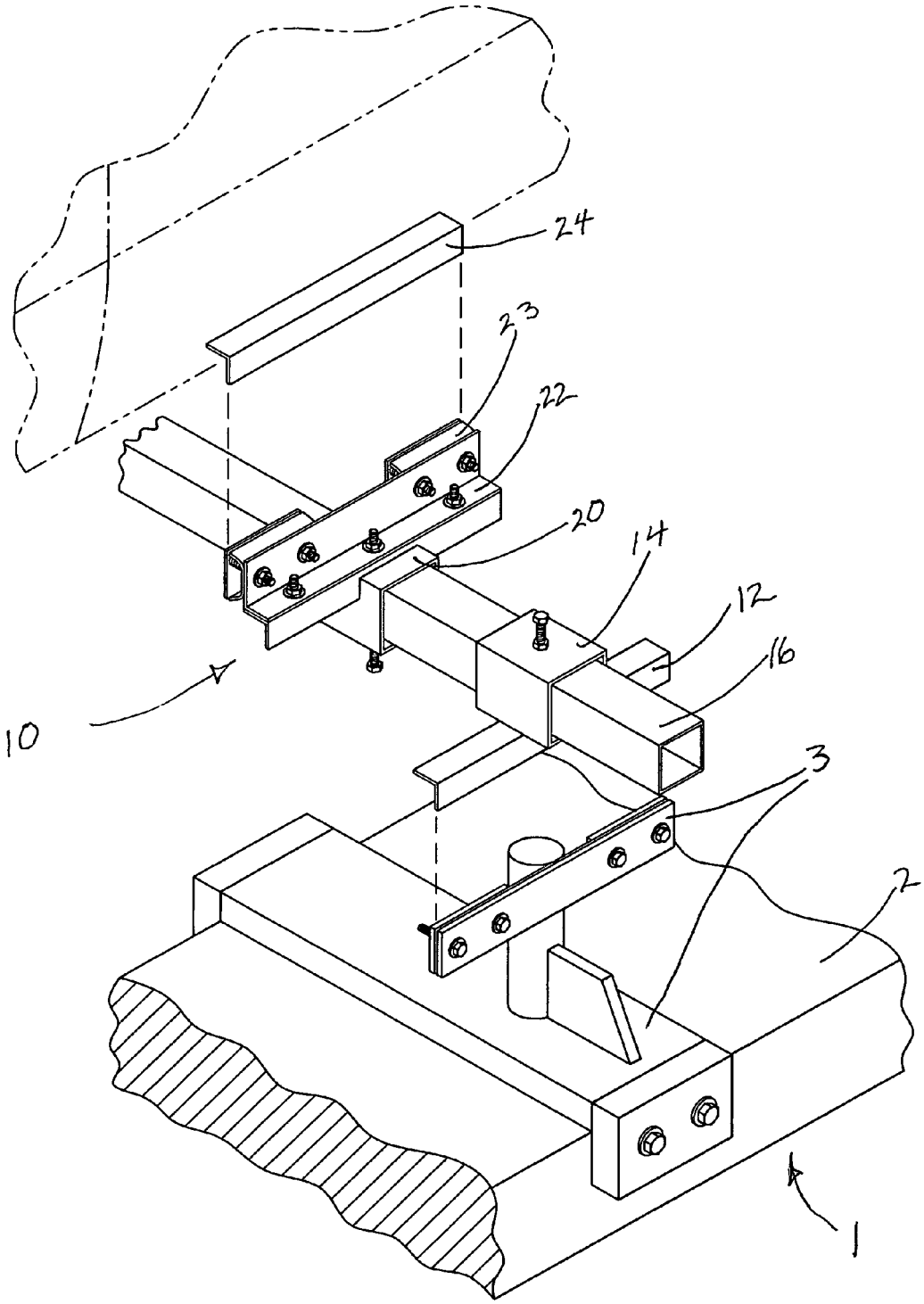
FIG. 3 is a perspective detail view thereof, with exploded portion, of the attachments to clamping assemblies.

Referring now to FIGS. 1, 2 and 3, the invention 10 makes use of a conventional vehicle frame rack 1 comprised of a parallel pair of spaced-apart tie-down tracks 2 equipped with tie-down assemblies 3, at least four, which can be releasably secured at selected points along the tie-down tracks 2. The tie-down assemblies 3 come with the frame rack from the manufacturer, and are intended to grasp the pinch welds, if any, or edges of the frame of a vehicle to be repaired, 4, shown in phantom in FIG. 1. Vehicle frame racks are available at auto body equipment shops. The present invention utilizes these tie-down assemblies 3 to releasably secure brackets 12 affixed to locking sleeves 14 supporting each end of crossbeams 16. Locking sleeves 14 on each tie-down track 2 and tie-down assemblies 3 are aligned so that crossbeams 16 are perpendicular to the long axes of tie-down tracks 2. Thus, together with tie-down tracks 2, cross beams 16 define a sturdy rectangular support frame to secure a vehicle frame against movement in any direction when pulling forces are applied to a vehicle body secured thereto.

Figure 4:
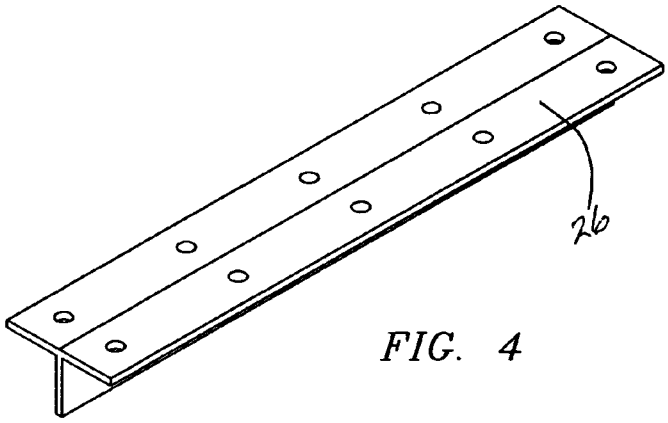
FIG. 4 is a detail view of a T-shaped bracket utilized by my invention for welding onto a rocker panel of a vehicle.
Figure 5:
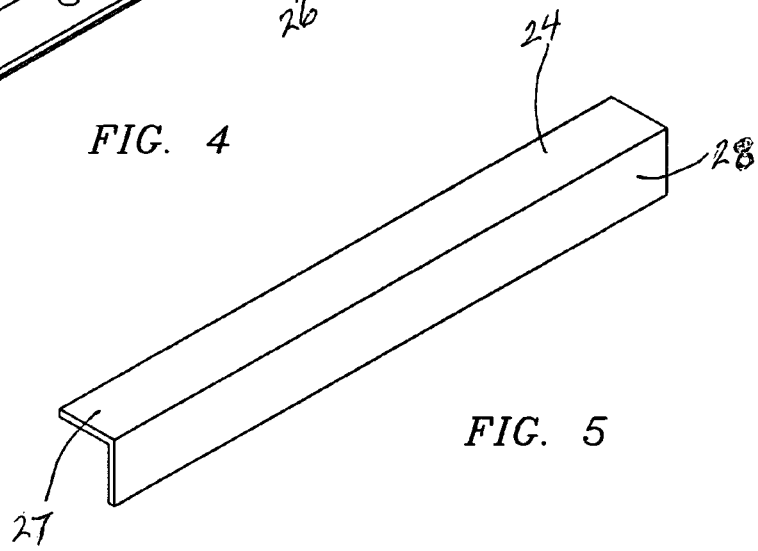
FIG. 5 is a detail view of an L-shaped bracket iron for welding onto the frame of a full-size frame vehicle.
Figure 6:
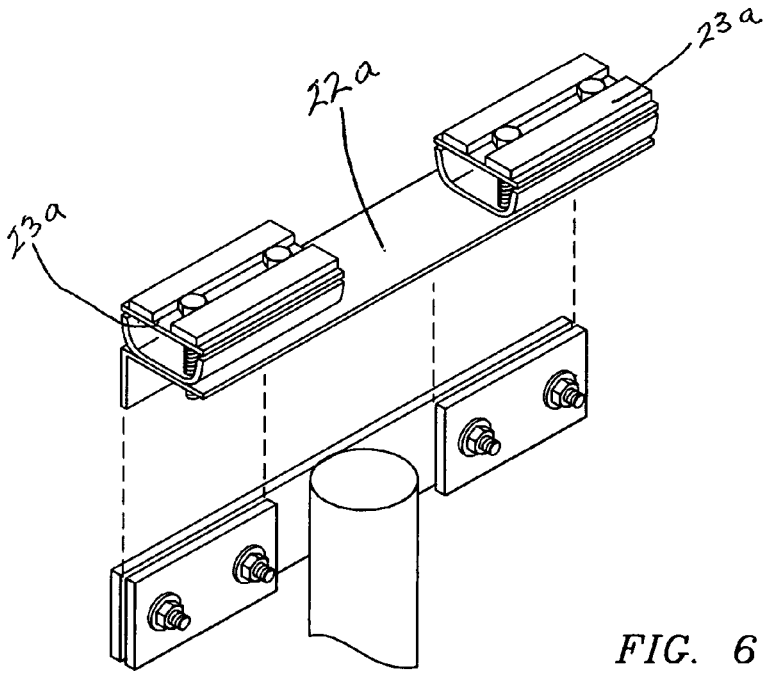
FIG. 6 is an exploded view of an alternative clamping assembly for use with Hondas or Acuras with horizontal pinch welds.

Each crossbeam 16 inserts through a second pair of locking sleeves 20 affixed to clamping assemblies 22 for releasably grasping a bracket, such as an angle iron 24 or T-shaped bracket 26, spot-welded on four corners of the frame at the base of the vehicle to be repaired. The clamps 23 are spring-loaded and are available at auto body equipment shops. Angle irons, (L-shaped brackets), 24, are appropriate for certain vehicles, such as full-size frames on trucks; other vehicles without pinch welds are best serviced with T brackets 26 shown in FIG. 4 under their rocker panels. For Hondas and Acuras, with horizontal pinch welds, crossbeams 16 and locking sleeves 14 and 20 are not necessary. Angle irons 24 are rotated 90° to present flange 27 projecting upward, which is welded to the frame, with flange 28 projecting horizontally below, thus requiring the clamps 23*a* of the clamping assembly 22*a* to lie horizontally as in FIG. 6, rather than vertically as in FIGS. 1, 2 and 3. Clamping assembly 22*a* is attached directly to tie-down assembly 3. All parts utilized in construction of the present invention can be purchased from either hardware stores or auto body equipment shops. Preferably, crossbeams 16 and locking sleeves 14 and 20 are square, and all parts of the invention should be made of hardened steel.

Operation and use of the present invention is as follows:

After positioning a damaged vehicle on the tie-down tracks of a conventional frame rack with tie-down assemblies, the vehicle should be elevated above the frame rack with air jacks. It is important that the vehicle be resting on the vehicle anchoring system and not on its wheels. Then the first step in securing a vehicle to the vehicle frame rack is to spot-weld at least four brackets, 24 or 26, to the frame of the vehicle, one at each corner at the base of the frame of the vehicle. The next two steps are (a) to attach at least four tie-down assemblies 3 of the frame rack, two on each tie-down track 2, to at least four brackets 12 supporting locking sleeves 14, and (b) to attach a clamping assembly 22 with affixed locking sleeve 20 to each of the four brackets, 24 or 26, welded to the frame. The next step is to align locking sleeves 14 with each other and with locking sleeves 20 horizontally perpendicular to tie-down tracks 2 by adjusting the position of the tie-down assemblies 3 so that one pair of sleeves 14 and one pair of sleeves 20 are in alignment under the forward end of the vehicle, and a second set of sleeves 14 and 20 are similarly aligned at the rear end of the vehicle. It is also necessary to adjust the position of the sliding locking sleeves 20 on crossbeams 16 so that clamping assemblies 22 are aligned with brackets 24 or 26 as the case may be, welded to the frame of the vehicle. The next step is to insert a crossbeam 16 through each set of aligned sleeves. The last step in securing the vehicle is to tighten the locking bolts 30 on the locking sleeves 14 and 20, thereby securing the vehicle against movement.

The foregoing description of the construction and operation of the vehicle anchoring system provides a simple and inexpensive device that can be manufactured from readily available and mass-produced parts, easily assembled, and quickly and easily attached to a vehicle to be repaired. The use of crossbeams adds rigidity and lateral strength to a conventional frame rack.

Although only two crossbeams are shown in the accompanying drawings, it is obvious to anyone skilled in the art that additional crossbeams with slidable support and vehicle attachment assemblies could be utilized to further strengthen the system of this invention, and it is intended that the scope of this invention include the aforementioned variation as well as other modifications and alternative embodiments in accordance with the substance defined by the following claims.

What is claimed is:

1. A universal vehicle anchoring system, for use with a standard universal vehicle frame rack accommodating both body-on-frame and unibody vehicles, said frame rack comprising a pair of horizontal vehicle tie-down tracks secured in spaced-apart relationship such that a vehicle can be positioned between them and secured in a stationary position, each said track being equipped with a plurality of vehicle support assemblies with clamps, said assemblies being securable at any selected point on said tie-down tracks, the anchoring system comprising:

At least two parallel spaced-apart crossbeams horizontally perpendicular to said tie-down tracks, each cross beam releasably connected to two said vehicle support assemblies, one on each tie-down track, and each releasably connected to a vehicle to be repaired, said vehicle having a base, one said cross-beam near the forward end of the base, and one said cross-beam near the rear of the base, whereby any two cross-beams together with said tie-down tracks define a rectangle; and At least four first releasably securable slidable sleeve means for insertion and support of a pair of said cross-beams near each end thereof, and said sleeve means being supported by first brackets clampable by said vehicle support assemblies, whereby said crossbeams are releasably secured to said vehicle support assemblies.

2. The invention according to claim 1, further comprising:

At least four second releasably securable slidable sleeve means for supporting vehicle clamping assemblies at selected positions on said crossbeams, said clamping assemblies releasably securable to the base of a vehicle to be repaired.

3. The invention according to claim 2, further comprising:

At least four second brackets, two for each side of the base of the vehicle to be repaired, welded to the base thereof, at fore and aft ends thereof, said brackets providing points of attachment for said vehicle clamping assemblies.

4. The invention according to claim 3, wherein said second brackets are T-shaped in cross-section for attachment to vehicles lacking pinch welds under their rocker panels.

* * * * *